United States Patent [19]

Michalik

[11] Patent Number: 5,057,064

[45] Date of Patent: Oct. 15, 1991

[54] FOLDING JAW CYLINDER

[75] Inventor: Horst B. Michalik, Höchberg, Fed. Rep. of Germany

[73] Assignee: Koenig & Bauer Aktiengesellschaft, Wurzburg, Fed. Rep. of Germany

[21] Appl. No.: 426,439

[22] Filed: Oct. 25, 1989

[30] Foreign Application Priority Data

Nov. 11, 1988 [DE] Fed. Rep. of Germany ..... 3838314

[51] Int. Cl.[5] ..... B65H 29/06; B65H 37/06

[52] U.S. Cl. ..... 493/8; 493/25; 493/424; 493/476

[58] Field of Search ..... 493/8, 23, 24, 425, 493/426, 476, 25, 424, 432, 433

[56] References Cited

FOREIGN PATENT DOCUMENTS 2537920 3/1977 Fed. Rep. of Germany .

0073111 4/1984 Japan ..... 493/25

*Primary Examiner*—James G. Smith

*Assistant Examiner*—Jack Lavinder

*Attorney, Agent, or Firm*—Jones, Tullar & Cooper

[57] ABSTRACT

A folding jaw cylinder has at least one set of movable folding jaws and a cooperating set of stationary folding jaws. The spacing between these sets of folding jaws can be varied in response to changes in paper ribbon thickness. Such variance in spacing is accomplishable during the operation of the folder. A measuring device is provided an senses the paper ribbon thickness in front of the folder. The second value is used to create an adjusting value that is fed to an adjusting device to accomplish the folding jaw adjustment.

14 Claims, 7 Drawing Sheets

FOLDING JAW CYLINDER

FIELD OF THE INVENTION

The present invention is directed generally to a folding jaw cylinder. More particularly, the present invention is directed to an adjustable folding jaw cylinder. Most specifically, the present invention is directed to an apparatus for adjusting the operating distance between cooperating folding jaw sets of a folding jaw cylinder. A moveable set of folding jaws and a stationary set of folding jaws are supported by spaced pairs of support disks on a folding jaw cylinder. The spacing between these two sets of jaws may be varied in accordance with the thickness of the product to be folded. This thickness can be sensed by a nominal value input sensor or computer. Sensed values are used to generate a valve that is used to rotate the support disks for the two jaw sets so that the spacing between the sets of jaws will correspond to the thickness of the product to be folded.

DESCRIPTION OF THE PRIOR ART

Folding jaw cylinder assemblies are quite well known in the art. In a typical folding jaw assembly, a product to be folded is inserted by a folding blade into a space between sets of folding jaws. One set of jaws may be pivotable between open and closed positions to allow the folded product to be carried around by the folding jaw cylinder from a point where the product is inserted between the folding jaws to a point where the folded product is released to a delivery fan or similar folded product receiving device.

The spacing between the two sets of folding jaws must be adjusted based on the thickness of the paper product to be folded. While one set of jaws is typically pivotable toward and away from the second set, this variance in spacing cannot accommodate large variances in paper web thickness. During the making up or make-ready of a rotary printing machine, it is often required that the operating distance between the folding blades must be adjusted to the product thickness of the paper web or ribbons being worked on. In practice, it is the daily routine that, for example in newspaper printing, paper webs of different web thicknesses are pasted together and finished during running of the printing machine. In is not unusual that thin paper of 28 $g/m^2$ is pasted to thick paper of 48 $g/m^2$.

One prior device that is useable to adjust the folding jaws of a folding jaw cylinder to new product thicknesses during operation of the printing machine is the assembly shown in German published examined patent application No. 2,537,920. In this prior device, a tapered sliding piece, which is supported in an axial borehole in the sliding jaw cylinder, is moved axially by means of a handwheel with an adjusting spindle. Radially aligned sliding tappets for each pair of folding jaws are affixed to the tapered sliding piece. Axial movement of the tapered sliding piece acts to move the sliding tappets radially. Radially outer ends of these tappets contact the adjustable folding jaw mechanism. This prior art folding jaw cylinder adjusting assembly, as discussed in German published examined patent application No. 2,537,920 allows only a manual adjustment of the folding jaws. It is also possible that the axially slidable tapered member can become lodged or can clamp in the borehole of the cylinder shaft. If this happens, the folding jaw cylinder is no longer adjustable.

It is evident that a need exists for a folding jaw cylinder which provides automatic adjustment of the spacing of the folding jaw sets and which can make this adjustment while the press assembly is in operation. The folding jaw cylinder of the present invention, as will be discussed subsequently, provides such a device and is a significant advance in the art.

SUMMARY OF THE INVENTION

It is an object of the present invention to provide a folding jaw cylinder.

Another object of the present invention is to provide an adjustable folding jaw cylinder.

A further object of the present invention is to provide a folding jaw cylinder in which the spacing between the folding jaws can be adjusted in accordance with paper web thicknesses.

Yet another object of the present invention is to provide a folding jaw cylinder that allows the spacing of the folding jaw sets to be adjusted automatically.

Still a further object of the present invention is to provide a folding jaw cylinder in which the folding jaw spacing is adjustable during operation of the folding jaw cylinder.

Even yet another object of the present invention is to provide a folding jaw cylinder which utilizes a measuring device to sense paper web thicknesses.

As will be discussed in greater detail in the description of the preferred embodiment which is set forth subsequently, the folding jaw cylinder assembly in accordance with the present invention includes at least one cooperating set of folding jaws. One set of jaws may be stationary while the second set will pivot with respect to the folding jaw cylinder to grasp and release folded paper products that are placed between the two sets of gripper jaws. Each of the sets of jaws are supported by spaced pairs of support disks which rotate with the folding jaw cylinder. In accordance with the present invention, these pairs of support disks are also rotatable with respect to the folding jaw cylinder. Rotation of the support disks will bring the stationary and movable jaw sets either closer together or further apart to vary the size of the space between them and hence the thickness of the folded paper product which they can accommodate. Rotation of the pairs of support disks is accomplished by adjusting supports which are moved by radial and axial adjusting shafts. These shafts are caused to turn by an adjusting motor. The adjusting motor operates either in response to the actual thickness of the paper web, as determined by a nominal value input sensor, or as provided by a nominal value input computer.

A particular advantage of the folding jaw cylinder of the present invention is that the operating spacing or distance between the folding jaws can be adjusted directly dependent on the real paper thicknesses. This means that adjusting errors, which might occur during manual adjustments, are eliminated. Thus the trial operation of the folding jaw cylinder, which has been required based on manual adjustments, can be eliminated. In a fully automatic, computer controlled schedule of the product cycle for a print production, the folder can be included as an integral part. Since the adjustment of the spacing of the folding jaws can be completely automated, this spacing can be changed as the printing unit automatically operates. These functional relationships are enhanced by the nature of the exclusively rotating adjustment means which controls the spacing of the folding jaws. It will thus be understood that the folding jaw cylinder assembly of the present invention is superior to the prior art devices.

BRIEF DESCRIPTION OF THE DRAWINGS

While the novel features of the folding jaw cylinder in accordance with the present invention are presented with specificity in the appended claims, a full and complete understanding of the invention may be had by referring to the detailed description of the preferred embodiment which is set forth hereinafter, and as illustrated in the accompanying drawings, in which:

DESCRIPTION OF THE PREFERRED EMBODIMENT

Figure 1:
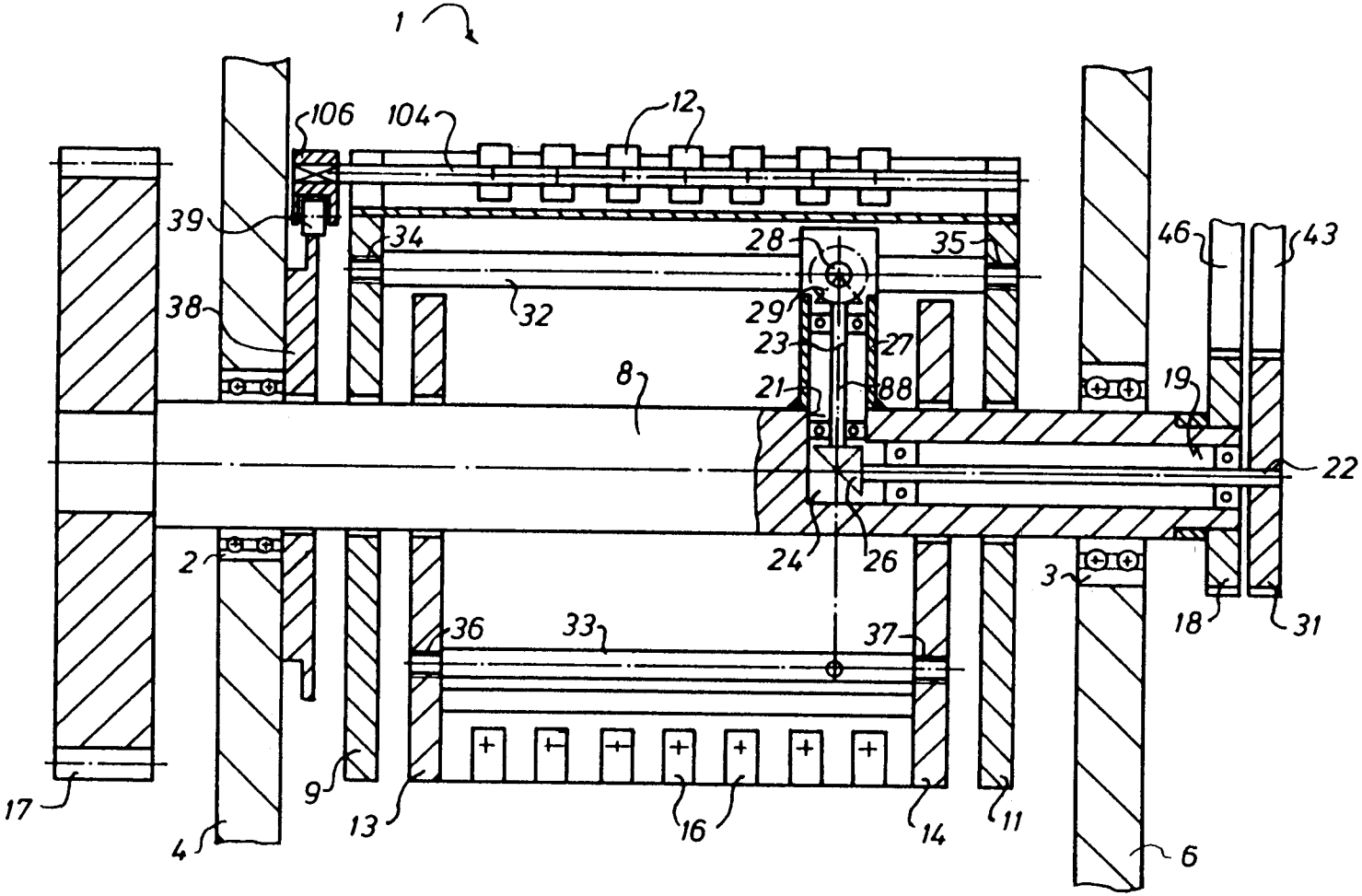
FIG. 1 is a longitudinal cross-sectional view of the folding jaw cylinder of the present invention.

Referring initially to FIG. 1 there may be seen a folding jaw cylinder 1 in accordance with the present invention. Folding jaw cylinder 1 is supported by suitable anti-friction bearings 2 and 3 in the side frames 4 and 6 of the folder, generally at 7, as may be seen schematically in FIG. 7. The folding jaw cylinder 1 includes a cylinder shaft 8; a supporting apparatus consisting of a first set of two support disks 9 and 11 for a first, movable row of folding jaws 12; and a supporting apparatus consisting of a second set of two support disks 13 and 14 for a second, stationary row of folding jaws 16. Of course, several rows of folding jaws 12 and 16 can be provided as well. For the sake of simplicity, however, only one row of folding jaws 12 and 16 will be described hereinafter.

The first and second sets of supporting disks 9 and 11, 13 and 14 are pivotably supported by means of friction bearings around the cylinder shaft 8 and are connected for rotation with the cylinder shaft 8 by means of suitable couplings which are not depicted. On a left end of the cylinder shaft 8, a driving gear 17 for the folding jaw cylinder is secured attached. On the right end of the cylinder shaft 8, a driven gear 18, whose purpose will be discussed in detail subsequently, is securely attached by any suitable means.

The cylinder shaft 8 is provided, at its right side, with an axial borehole 19 which extends at least about third of the cylinder shaft length. A radial borehole 21 is provided at the inner end of the axial borehole 19. These boreholes 19 and 21 serve to receive adjusting shafts 22 and 23 supported in antifriction bearings, which at a deflection point 24, are in rotatory force transmission with each other by means of a first bevel gear set 26 that consists of two meshing bevel gears.

A length of pipe 27 is welded or otherwise secured to the periphery of cylinder shaft 8 and serves as a radial extension of the radial borehole 21. This section of pipe 27 serves as a fixed bearing support for an adjusting spindle 28 that is shown in greater detail in FIG. 2. This adjusting spindle 28 has a right hand thread at one end and a left hand thread at its opposite end. The adjusting spindle 28 is also in rotary force transmission with the radially arranged adjusting shaft 23 by means of a second bevel gear set 29 which consists of two meshing bevel gears. The axial adjusting shaft 22 is supported in axial bore 19 in cylinder shaft 8 with its right end extending out of the borehole 19 and carrying a driving gear 31 in rotation therewith which driving gear 31 has the same diameter as the driven gear 18.

Figure 2:
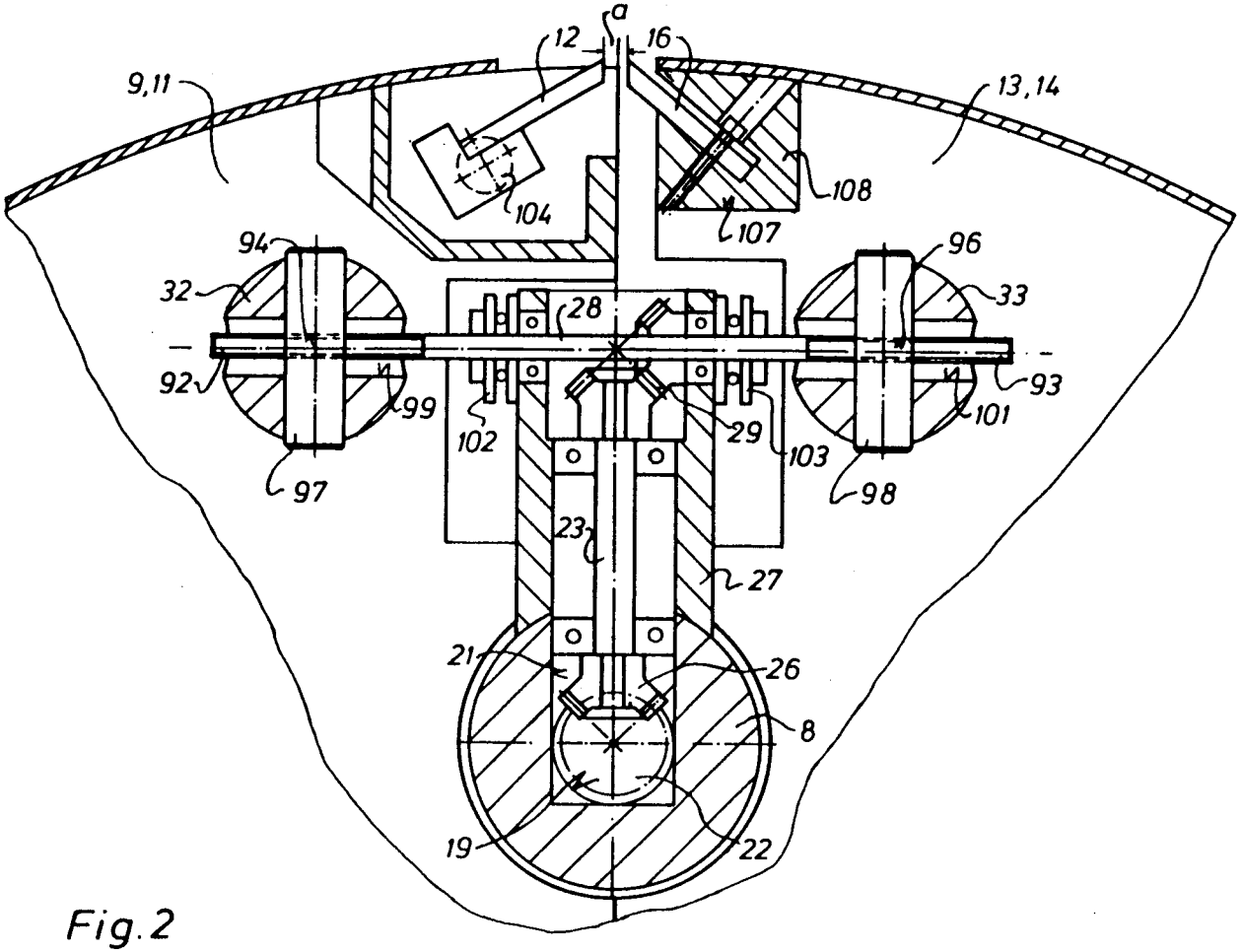
FIG. 2 is a partial transverse cross-sectional view through the folding jaw cylinder.

The adjusting spindle 28 is, with its left-hand and right-hand threaded ends, in screw contact with adjusting supports 32 and 33 respectively, as may be seen in FIG. 2. The adjusting supports 32 and 33 are each supported in radially arranged, axially extending holes 34 to 37 in the supporting disks 9 and 11, and 13 and 14. Due to the arrangement of the adjusting supports 32 and 33 in the long holes 34 to 37, compensating movements can be carried out which are required to convert the transitional movement created by adjusting shaft 28 into a rotational movement of the supporting disks 9 and 11, and 13 and 14. This rotational movement of these first and second pairs of supporting disks, 9 and 11, and 13 and 14, respectively will, in turn, effect relative movement of the movable jaw set 12 and the fixed jaw set 16 toward and away from each other. As may be seen in FIG. 2, this relative movement of these two jaw sets will vary the spacing distance "a" so that folded products formed from paper webs or ribbons of different thicknesses may be accommodated.

The moveable jaw set 12 is carried on its rotatable folding jaw shaft 104 for pivotable motion caused by a control cam follower 39 that is carried by a cam follower holder 106, all as may be seen in FIG. 1. This control cam follower 39 rides on a control cam 38 that is secured to a side frame 4. Thus as the folding jaw cylinder is rotated by drive gear 17 in a generally known manner, the moveable row of folding jaws 12 will open and close with respect to the stationary set of folding jaws 16 in a generally conventional manner. As discussed above, the operating distance "a" between the jaw sets 12 and 16 is adjusted by the present invention.

Figure 5:
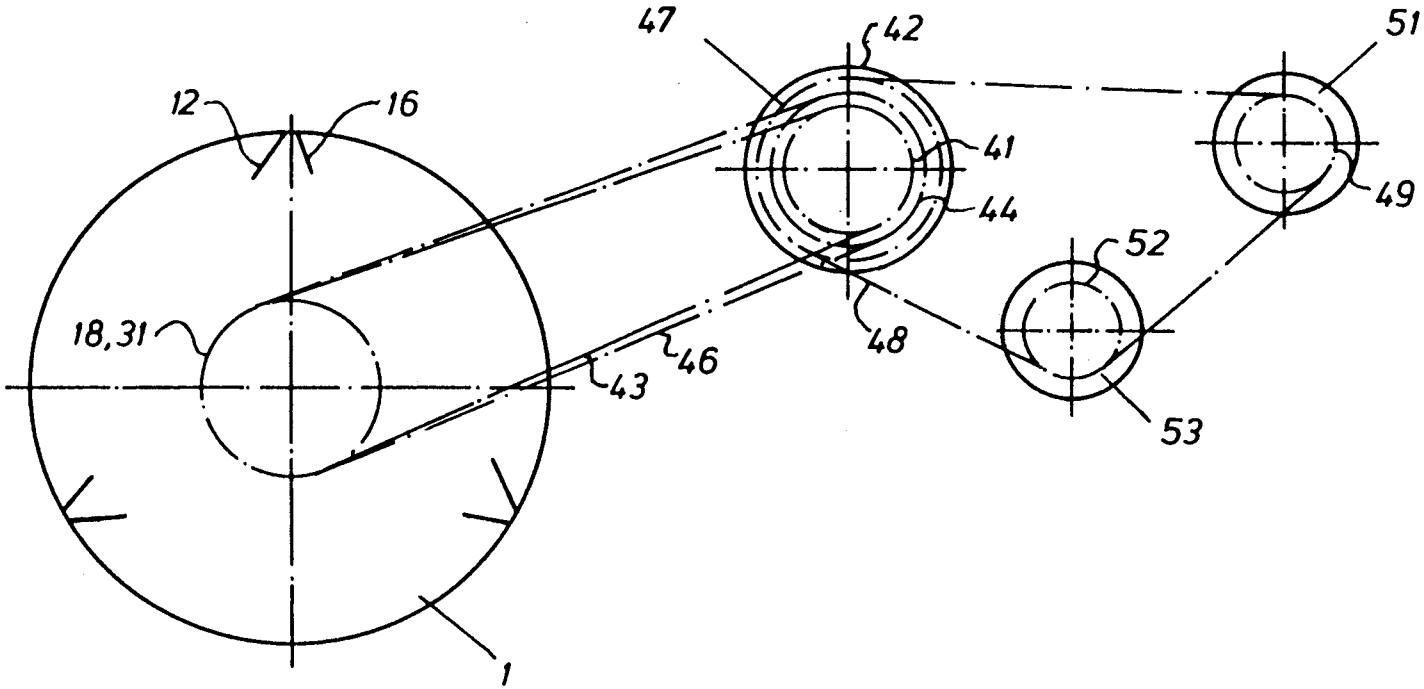
FIG. 5 is a schematic representation of a control drive arrangement for folding adjustment of the folding jaw assembly.

A driving gear 31, which is used to accomplish the adjustment of the operating distance "a", is secured to the outermost right end of axial adjusting shaft 22 which is rotatably supported in axial bore 19 in cylinder shaft 8. The driving gear 31 is driven by a driven part 41 of an adjusting gear mechanism 42 by means of a first tooth belt 43, as seen in FIG. 5. The adjusting gear mechanism 42 includes, in addition to the driven part 41, a driving part 4 which is in drive connection with the driven gear 18 of the folding jaw cylinder shaft 8 by means of a second tooth belt 46, and a control part 47, which is in driven connection with a driving gear 49 of an adjusting motor 51 and a driving gear 52 of an actual value sensor 53 by means of third tooth belt 48.

Figure 6:
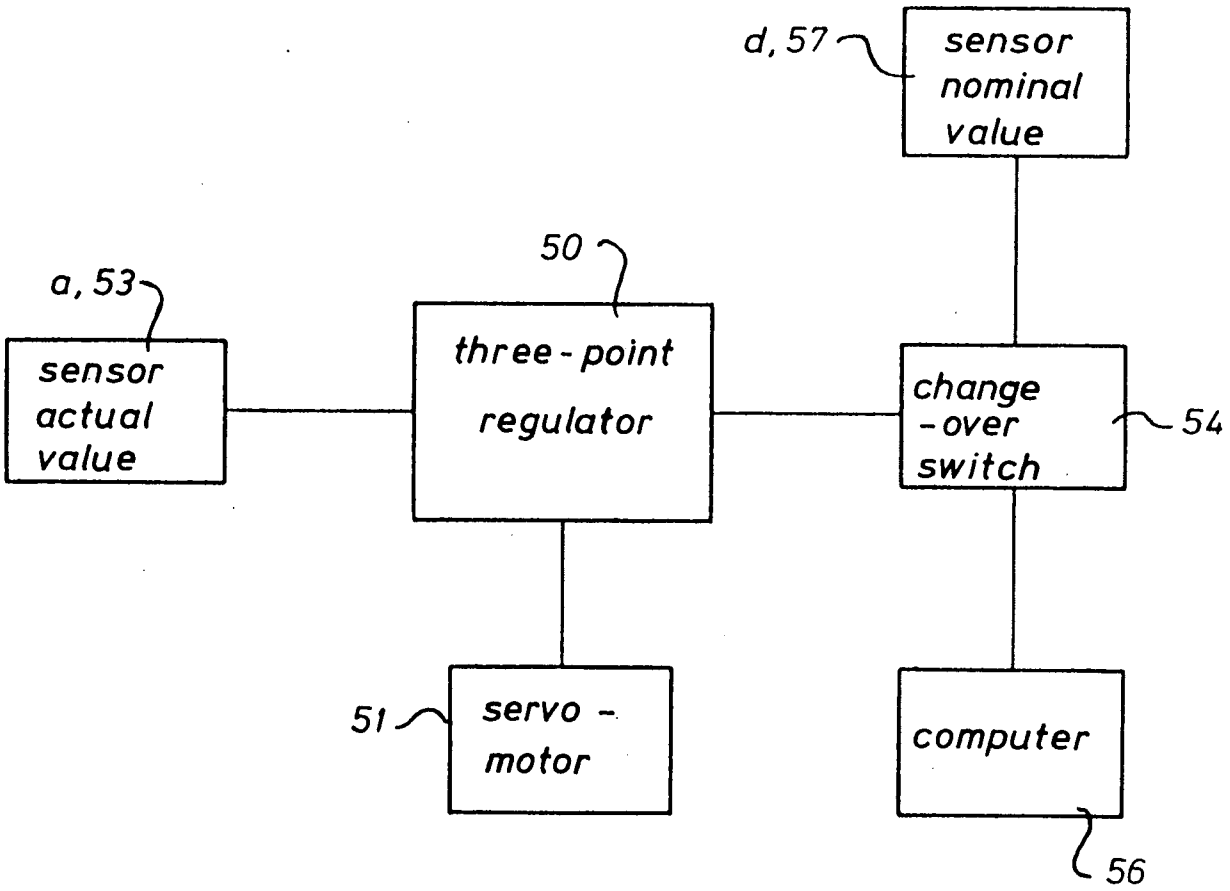
FIG. 6 is a block diagram of a regulator arrangement for the folding jaw cylinder.

Adjusting motor 51 receives control commands in the form of electric signals generated by a three point regulator 50. As may be seen in FIG. 6 a connection of actual and nominal values for the generation of an adjusting value of the adjusting motor 51 may be provided through the three point regulator 50. The three point regulator 50 is connected to an actual value sensor 53 and to a change-over switch 54 by means of an electric line. The change-over switch 54 transmits one of two alternate nominal values to the three point regulator 50. This nominal value, which is representative of the paper ribbon thickness "d", can alternatively be input by means of an input device of a computer 56 or by means of a sensor 57. The sensor 57 measures the actual thickness "d" of a paper ribbon 58 which is being transmitted to the folder 7. The sensor 57, as seen in paper ribbon transport direction, typically is arranged behind a transfer roller 61 and in front of a pair of drag rollers 62, all as is schematically depicted in FIG. 7.

Figure 7:
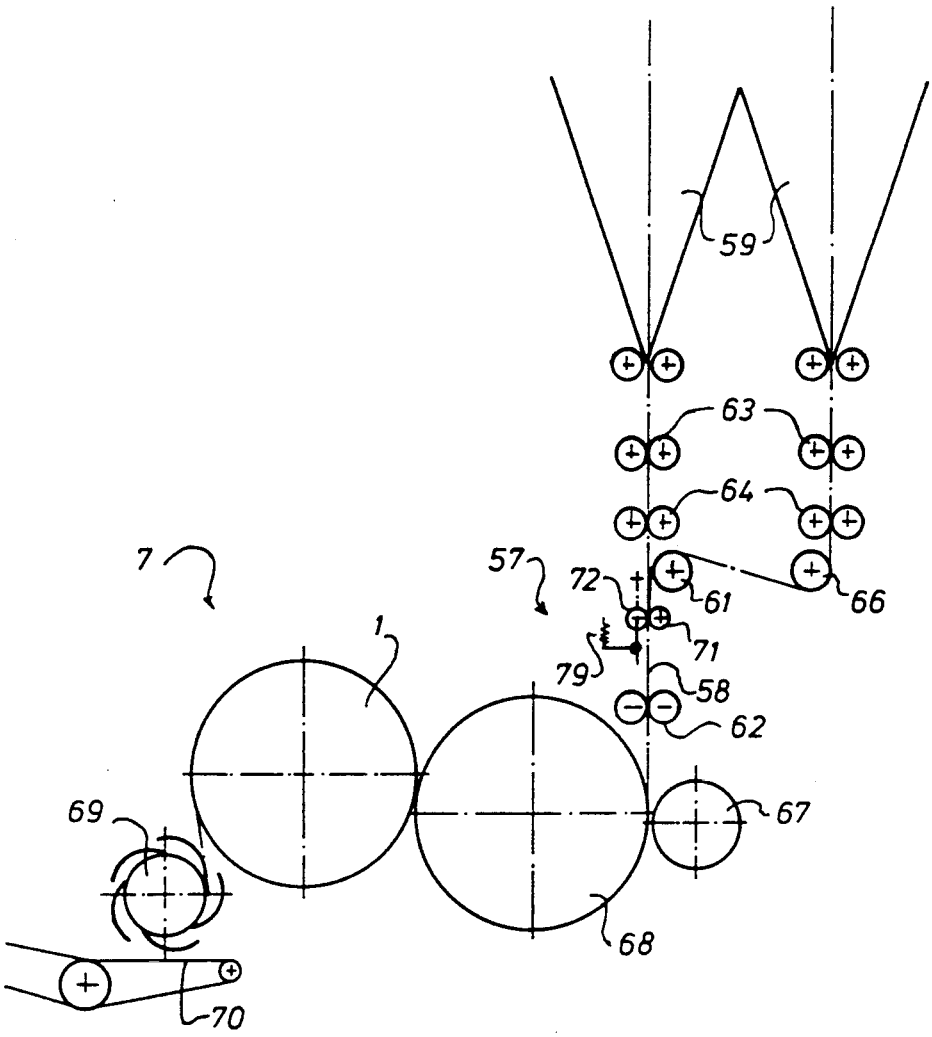
FIG. 7 is a schematic representation of an overall folder assembly in which the folding jaw cylinder in accordance with the present invention may be used.

As may be seen in FIG. 7, a former 59 receives webs of printed product and directs this product through groups of drag rollers 63 and 64. One web then passes around a transfer roller 66 and then over the transfer roller 61 which is located before the nominal value sensor assembly 57. The paper web 58 then progresses through the downstream drag rollers 62 and along into the folder 7. Again, as may be seen in FIG. 7, folder 7 may include a cutting cylinder 67, a cooperating collector cylinder 68 which collects the cut webs that have been cut by cutting cylinder 67, and the folding jaw cylinder 1, which folds the collected web products. Once these products have been folded by folding jaw cylinder 1, they are taken over by a delivery fan 69 and are then deposited on a transport tape 70.

Figure 3:
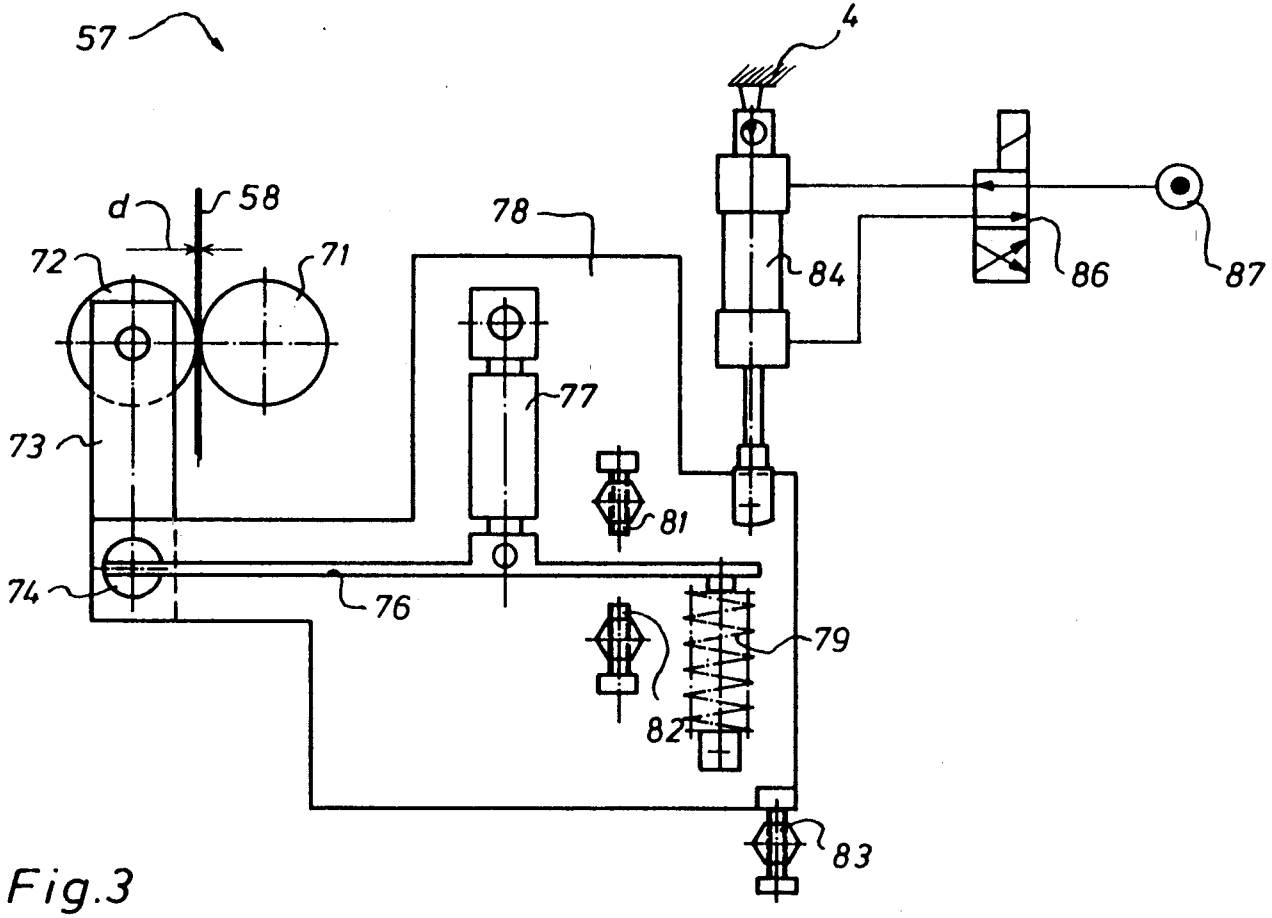
FIG. 3 is a schematic depiction of a paper ribbon thickness measuring apparatus in accordance with the present invention.
Figure 4:
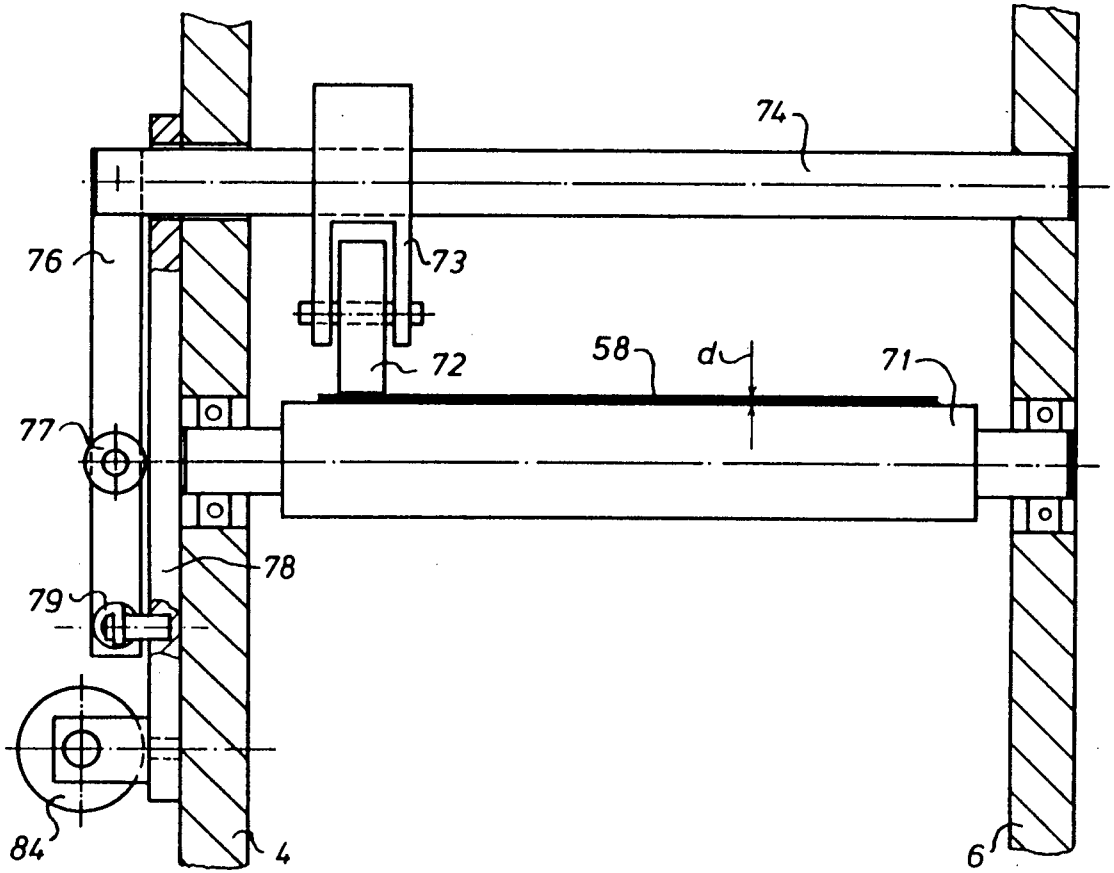
FIG. 4 is a side elevation view, partly in section and showing the paper ribbon thickness measuring apparatus installed on the machine side frame.

Nominal value sensor 57 is situated between transfer roller 61 and drag rollers 62, as is shown in FIGS. 3 and 4. As may be seen most clearly in FIG. 3, this sensor 57 includes a rotatably supported roller 71, which is preferably chromed, and a chromed measuring roller 72 that is pivotably supported and is movable toward and away from roller 71 in accordance with the thickness "d" of the paper ribbon 58. As may be seen in FIG. 4, support roller 71 is supported in the side frames 4 and 6 for the folder. The measuring roll 72 is rotatably supported at a first end of a lever arm 73. A second end of lever arm 73 is fixed for rotation on a shaft 74 which is pivotably supported in the side frames 4 and 6. The paper ribbon 58 is caused to pass between the roller 71 and the measuring roll 72 so that, in response to the paper ribbon thickness "d", the measuring roll 72 is displaced thus resulting in a pivotable movement of the shaft 74.

An adjusting lever 76 is provided and is secured on one end of the shaft 74 that protrudes through the side frame 4. This adjusting lever 76 is attached at approximately its middle to a displacement transducer such as a moving coil device 77 which is pivotably secured at one end on a frame plate 78 of the sensor 57. A return spring 79, which is fixed on the frame plate 78, is attached to a second end of the adjusting lever 76. Two adjustable stops 81 and 82 are fixed on the frame plate 78 and limit the pivoting angle of the adjusting lever 76 and therefore the maximum displacement of the measuring roll 72. The maximal displacement can, for example, be obtained as a result of a web break with a paper jam. In this case the stops 81 and 82 protect the moving coil device 77 from being destroyed.

The frame plate 78 is pivotably supported by the shaft 74 and is located between the side frame 7 and the adjusting lever 76, as shown in FIG. 4. The frame plate 78 is pivoted by an air cylinder 84 that is fixed on the side frame 4 and acts on one end of the frame plate 78. An adjustable stop 83 is fixed on the side frame 4 and limits the position of the frame plate 78 for a zero position of the measuring roll 72 with respect to the roller 71. In the zero position the circumferential surfaces of the roller 71 and the measuring roller 72 are in contact. In this zero position, the paper ribbon thickness "d" is equal to zero. The air cylinder 84 is pivotably connected on one outer side of the side frame 4 and is joined to a pressure generating source 87 by means of an on/-off valve 86.

To measure the paper ribbon thickness "d", the measuring roll 72 is moved toward the stationary roller 71 by means of the air cylinder 84. The air cylinder 84 pivots the frame plate 78 toward the stop 83. The measuring roll 72 is also pivoted until it contacts the paper ribbon 58. The remaining pivoting distance until the side frame plate 78 contacts the stop 83 is made by a relative pivoting movement of the adjusting lever 76. Due to the pivoting movement of the adjusting lever 76, a solenoid plunger of the moving coil device 77 is moved relative to the frame plate 78. A voltage signal that is created by this sliding movement is fed as the nominal value, depending on the measurement, to the three point regulator 50. After a comparison of this nominal value with the actual value sensed by the actual value sensor 53 designed as a three phase pulse generator, the adjusting value is created and this is fed as a voltage signal to the adjusting motor 51.

Instead of the moving coil device 77, other sensor can be used as well. In that respect, contactless and contacting sensor measuring devices are both equally useable. It is possible to provide a nominal value for the operating distance of the folding jaws "a" by means of an input device not represented by the computer 56 to enable a presetting of the folder 7 with the device described depending on the production. This nominal value can alternatively be determined by measuring the paper ribbon thickness "d" and, after a comparison of nominal/actual value, be transmitted as an adjusting command to the adjusting motor 51.

As is shown in FIG. 5, the adjusting motor 51 rotates its driving gear 49 more or less to the right or to the left depending on the amount and the direction of the adjusting value. Due to the belt connection 48 of the adjusting motor 51 with the control part 47 of the adjusting gear mechanism 42, during the rotation of adjusting motor 51, a transmission between the driving part 41 and the driven part 44 is generated. This transmission results in a relative movement between driving gear 31 and driven gear 18 and thus in a rotation of the axial adjusting shaft 22 and hence of the radial adjusting shaft 23 around its axis of rotation 88. Rotation of the radial adjusting shaft 23 results in a rotation of the adjusting spindle 28 which, as may be seen most clearly in FIG. 2 is in gear communication with radial adjusting shaft 23 through the second bevel gear set 29. The rotation of the adjusting spindle 28 causes the first set of support disks 9 and 11 for the movable folding jaw set 12 to move with respect to the second set of support disks 13 and 14 for the stationary folding jaw set 16.

Again referring to FIG. 2, it may be seen that the oppositely threaded ends 92 and 93 of the adjusting spindle 28 project into threaded boreholes 94 and 96 of bolts 97 and 98, respectively. Each of these bolts 97 and 98 is carried by one of the support disk adjusting supports 32 or 33. Transverse enlarged boreholes 99 and 101 are provided in adjusting supports 32 and 33, respectively so that the threaded ends 92 and 93 of the adjusting spindle 28 can project into and through the threaded boreholes 94 and 96 in the bolts 97 and 98. It will be understood that the depiction in FIG. 1 of the movable row of folding jaws 12 and the stationary row of folding jaws 16 as being diametrically opposite each other is only to enhance the understanding of the structure of the folding jaw cylinder of the present invention. In actuality, these two sets of jaws 12 and 16 are adjacent each other, as seen in FIG. 2 and the adjusting spindle 28 is threaded into both adjusting supports 32 and 33.

Spaced thrust bearings 102 and 103 surround the adjusting spindle 28 and protect the bevel gears on the bevel gear set 29 from any axial loads that might be caused by the rotational movement of the first and second sets of support disks 9 and 11, and 13 and 14; respectively. As may also be seen in FIG. 2 taken in conjunction FIG. 1, the folding jaw shaft 104 is pivotably supported in the first set of support disks 9 and 11 and carries a plurality of folding jaws 12 which are fixedly supported in a spaced array along folding jaw shaft 104. Thus as folding jaw shaft 104 is pivoted by movement of the cam follower 39 as its rides on the fixed control cam 38 during rotation of the folding jaw cylinder 1, the movable row of folding jaws 12 will move toward and away from the stationary jaws 12.

The second set of support disks 13 and 14 each have a seat 107 at their periphery. These seats 107 receive the ends of a folding jaw bar 108. The stationary folding jaws 16 are secured at spaced distances to this stationary folding jaw bar 108. Thus these stationary folding jaws 16 only move if the second set of support disks 13 and 14 move, as would be the situation when the spacing "a" is to be varied in response to a change in the thickness "d" of the paper ribbon, as secured by sensor 57, or in response to a change in the nominal value as provided to the adjusting motor 51 through the three point regulator 50 by the nominal value input computer 56.

If there is no adjustment to be made to the spacing between the movable row of folding jaws 12 and the stationary set of folding jaws 16, the axial adjusting shaft drive gear 31 rotates at the same speed as the driven gear 18 carried by the cylinder shaft 8. This means that there is not relative rotation between the cylinder shaft 8 and the axial adjusting shaft 22. Hence the radial adjusting shaft 23 will not rotate about its axis of rotation 88.

While a preferred embodiment of a folding jaw cylinder in accordance with the present invention has been set forth fully and completely hereinabove, it will be apparent to one of skill in the art that a number of changes in, for example, the size of the folding jaw cylinder, the number of sets of movable and stationary sets of folding jaws, the types of bearings used and the like can be made without departing from the true spirit and scope of the invention which is accordingly to be limited only by the following claims.

What is claimed is:

1. A folding jaw cylinder assembly in a folder of a printing machine, said folding jaw cylinder assembly comprising:

a hollow rotatable shaft supporting said folding jaw cylinder assembly in said printing machine;

at least a first set of cooperating folding jaws carried by said folding jaw cylinder, said at least first set of cooperating folding jaws having a plurality of movable folding jaws carried on a folding jaw shaft and a plurality of stationary folding jaws carried on a folding jaw bar, said movable folding jaws and said stationary folding jaws in said at least first set of cooperating folding jaws being spaced at an adjustable folding jaw operating distance from each other;

a first pair of spaced support disks rotatably supported on said hollow shaft and receiving spaced ends of said folding jaw shaft;

a second pair of spaced support disks rotatably supported on said hollow shaft and receiving spaced ends of said folding jaw bar;

a first adjusting support extending between said first pair of spaced support disks and a second adjusting support extending between said second pair of spaced support disks;

a first threaded borehole in said first adjusting support and a second threaded borehole in said second adjusting support;

a rotatable adjusting spindle supported by said hollow shaft and having a first end received in said first threaded borehole in said first adjusting support and a second end received in said second threaded borehole in said second adjusting support;

means for sensing a thickness of a paper ribbon to be folded by said folded jaw cylinder; and means for rotating said adjusting spindle to move said first and second adjusting supports with respect to each other to vary the spacing between said movable folding jaws and said stationary folding jaws to adjust said adjustable folding jaw operating distance in response to said sensed thickness of said paper ribbon.

2. The folding jaw cylinder assembly of claim 1 wherein said means for sensing said thickness of said paper ribbon includes a paper ribbon thickness measuring device positioned in paper transport direction in front of the folder.

3. The folding jaw cylinder assembly of claim 1 wherein said means for adjusting said adjustable folding jaw operating distance further includes an axial adjusting shaft and a radial adjusting shaft, both said axial adjusting shaft and said radial adjusting shaft being rotatably supported by said hollow shaft.

4. The folding jaw cylinder assembly of claim 3 wherein said axial adjusting shaft and said radial adjusting shaft are in driving connection to each other through a first bevel gear set and further wherein said radial adjusting shaft and said rotatable adjusting spindle are in driving connection to each other through a second bevel gear set.

5. The folding jaw cylinder assembly of claim 3 wherein said axial adjusting shaft is rotatably supported in an axial bore in said hollow shaft.

6. The folding jaw cylinder of claim 3 wherein said radial adjusting shaft is rotatably supported in a radial bore in said hollow shaft.

7. The folding gear assembly of claim 3 wherein a first end of said axial adjusting shaft extends outwardly beyond said hollow shaft and carries a drive gear.

8. The folding jaw cylinder assembly of claim 1 wherein said means for measuring said thickness of said paper ribbon includes a stationary rotatable roller and a pivotable rotatable measuring roller.

9. The folding jaw cylinder assembly of claim 8 wherein said measuring roller is spring biased toward said stationary roller.

10. The folding jaw cylinder assembly of claim 8 wherein said measuring roller is movable out of contact with said stationary roller.

11. The folding jaw cylinder assembly of claim 8 said measuring roller is supported by a pivotable frame plate that is pivotably connected by an air cylinder to a frame portion of the folder.

12. The folding jaw cylinder assembly of claim 8 wherein said pivotable measuring roller is connected to an air adjusting lever that operates a moving coil device.

13. The folding jaw cylinder assembly of claim 8 further wherein a lever arm which carries said measuring roller at a first end has a second end secured to a rotatable shaft which also receives a first end of an adjusting lever whose second end is attached to a first end of a return spring and further wherein a second end of said return spring is attached to a frame plate, said adjusting lever being connected intermediate its first and second ends to a first end of a displacement measuring means whose second end is attached to said frame plate whereby relative movement between said frame plate and said adjusting lever will cause said displacement measuring means to measure a displacement of said pivotable measuring roller with respect to said stationary roller.

14. The folding jaw cylinder assembly of claim 1 wherein said first threaded borehole in said first adjusting support is formed in a first bolt portion of said first adjusting support and further wherein said second threaded borehole in said second adjusting support is formed in a second bolt portion of said second adjusting support.

* * * * *